US006679525B1

(12) United States Patent
Picken

(10) Patent No.: US 6,679,525 B1
(45) Date of Patent: Jan. 20, 2004

(54) RAIL SKIING

(76) Inventor: Egan Picken, 39 Old South Country Rd, Brookhaven, NY (US) 11719

( * ) Notice: Subject to any disclaimer, the term of this patent is extended or adjusted under 35 U.S.C. 154(b) by 11 days.

(21) Appl. No.: 10/199,714

(22) Filed: Jul. 22, 2002

(51) Int. Cl.[7] ..... A63C 11/00
(52) U.S. Cl. ..... 280/809; 280/607; 280/603; 280/609
(58) Field of Search ..... 280/809, 603, 280/609, 600, 636, 601, 11.12, 11.14, 11.15, 11.16, 11.17, 11.18, 11.19

(56) References Cited

U.S. PATENT DOCUMENTS 1,240,232 A * 9/1917 McNamee ..... 280/809
4,022,482 A * 5/1977 Powell ..... 280/809
4,537,419 A * 8/1985 Kiernan ..... 280/607
5,221,111 A * 6/1993 Younger ..... 280/809
5,967,552 A 10/1999 Roderick et al.
6,568,710 B2 * 5/2003 Kim ..... 280/809

* cited by examiner

*Primary Examiner*—Brian L. Uchinson
*Assistant Examiner*—Hau Phan
(74) *Attorney, Agent, or Firm*—Myron Amer P.C.

(57) ABSTRACT

To effectively clear for a skier preparatory to a downhill skiing run other skiers that otherwise might be in harm's way, use is made of a metal rail of a rectangular shape in cross section marking the beginning of the ski run on which the skier balances on one leg using a bracket extending laterally of an outboard side of a ski boot that tracks along the top of the rail, wherein the skier's two skis are in the ready to complete the skiing run when the skier dismounts from the end of the rail onto the ski slope.

1 Claim, 1 Drawing Sheet

RAIL SKIING

The present invention relates generally to improvements in downhill skiing in which, more particularly, the improvements provide a skiing style that, if the skier has the proficiency it demands, contributes to enhanced enjoyment of the sport.

EXAMPLE OF THE PRIOR ART

U.S. Pat. No. 5,967,552 for "In-line Wheeled Skate" issued to Roderick et al. on Oct. 19, 1999 documents a sport gaining popularity in which a participant wearing in-line roller skates balances on a banister or rail along a staircase during a downward descent therealong. The sport thusly practiced has entertainment value, but is obviously limited by its indoor nature, the position of the participant being necessarily in a sidewise orientation to the path of descent and, most significant, that the length of the rail delimits the downward descent or run, as well as other drawbacks.

Broadly, it is an object of the present invention to overcome the foregoing and other shortcomings of the prior art.

More particularly, it is an object to use to advantage a rail for downhill skiing, and thusly promoting an innovative skiing style contributing to increased speed at the beginning of a downhill run, and yet having an attendant benefit of increased safety to the skiing participants, all as will be better understood as the description proceeds.

The description of the invention which follows, together with the accompanying drawings should not be construed as limiting the invention to the example shown and described, because those skilled in the art to which this invention appertains will be able to devise other forms thereof within the ambit of the appended claims.

Figure 1:
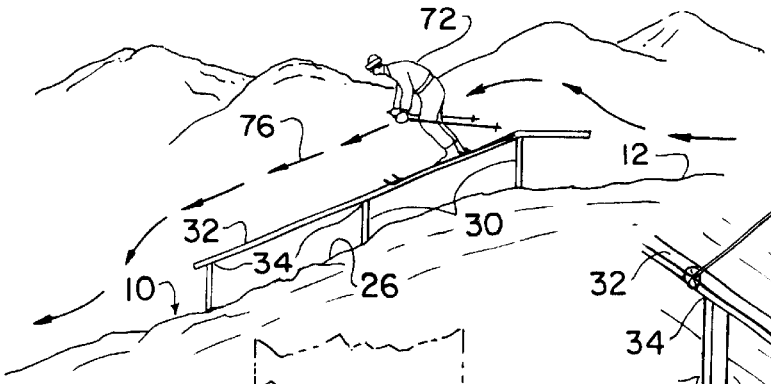
FIG. 1 is a side elevational view of a skier partaking of rail skiing in accordance with the present invention.
Figure 2:
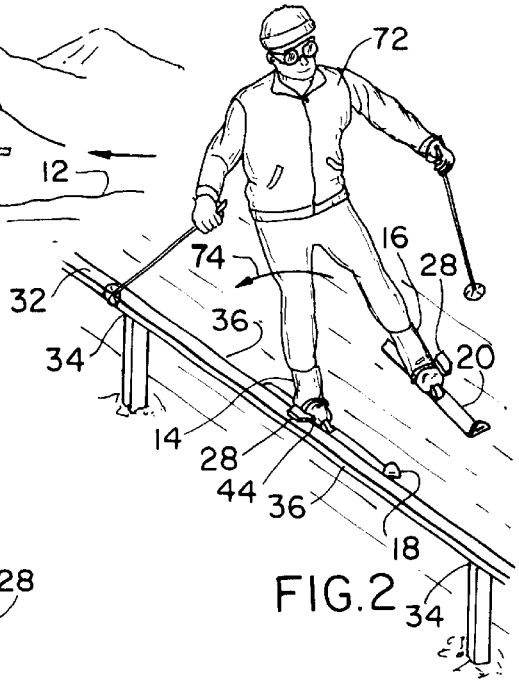
FIG. 2 is a detailed slightly enlarged scale perspective view of the skier.
Figure 3:
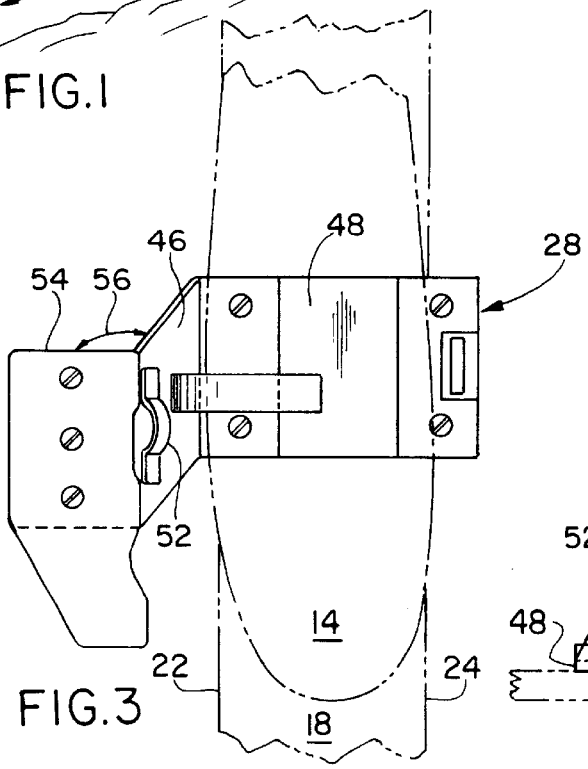
FIG. 3 is an isolated plan view, also in an enlarged scale, of a ski boot-attached skiing component for establishing skiing contact with a rail component during the rail skiing activity, the ski boot and ski being illustrated in phantom perspective.
Figure 6:
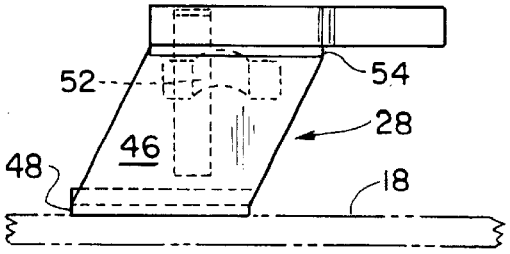
FIG. 6 is a left side elevational view projected from FIG. 4, but omitting a strap component.

The top or starting site from a descent down a ski slope 10 is, in skiing parlance, known as a table top 12 from which a skier equipped with ski boots 14 and 16, and to each an attached ski 18 and 20, starts the descent, the speed of which is controlled by side edges 22 and 24 lengthwise of each ski 18, 20 which provide a steering function when placed into contact with the surface 26 of the ski slope 10 using a sidewise shifting in weight, the control being manifested by a curvilinear path at a diminished, and thus controlled, speed of descent, as compared with a much greater rate of speed of a linear path of descent.

When skiing proficiency permits however, a skiing boot fitting bracket, generally designated 28 of the present invention provides an option of a linear skiing descent or skiing style, and thus at a greater speed. Cooperating with the skiing bracket 28 to provide the skiing style option is a ski slope modification consisting of spaced apart vertical supports, individually and collectively designated 30, of graduated height sizes starting at the table top 12 and providing a downwardly angled support which in a preferred embodiment is appropriate to support a rail 32 which is approximately no less than fifteen feet long. Rail 32 is rectangular in cross section of metal construction material successively welded as at 34, atop of the supports 30 and, in a preferred embodiment having opposite sides 36 of approximately not less than three inches in height and a flat top 38 subtending angles 40 of ninety degrees, thusly forming operative tracking edges 42 lengthwise of and for the length of the rail 32, with which one or the other of the tracking edges 42 of the previously noted skiing bracket 28 in use is effective to establish a skiing engagement therewith, as noted at 44. In use, the rail top 38 is iced over, waxed or otherwise appropriately lubricated to establish the slippage noted at 44.

An angularly oriented plate 46 extends from the flat plate 48 providing a clearance 50 from an outboard side of the ski boot 16 for a welded-on strap loop 52. Completing the construction of the bracket 28 is a laterally extending plate 54 subtending an angle 56 slightly greater than ninety degrees opening into a positioning compartment 58 formed by the plates 46, 54, and into which compartment 58 the rail tracking edge 42 is projected incident to establishing therewith the sliding contact 44.

Figure 4:
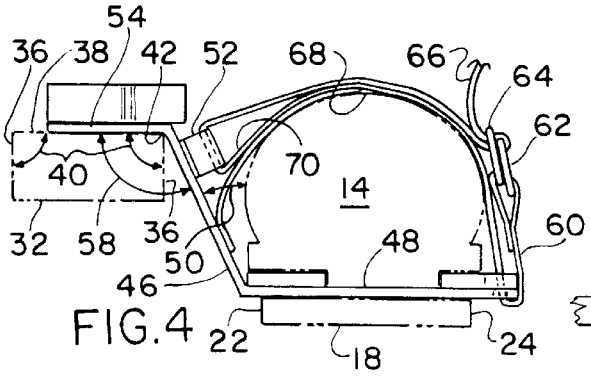
FIG. 4 is a front view projected from FIG. 3.
Figure 5:
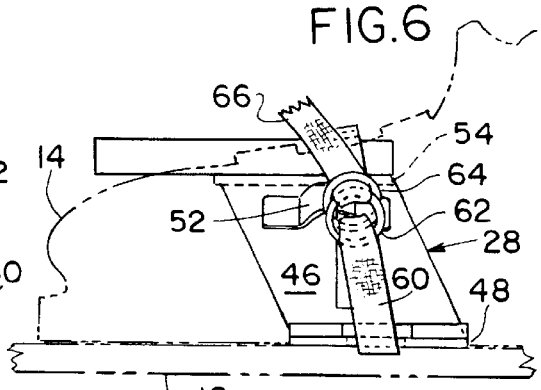
FIG. 5 is a partial right elevational view projected from FIG. 4.

As best understood from FIG. 4, the closed loop attachment 53 of the web material clamping strap 60 is two rings 62 and 64, thus securing the rings in place, and threaded through the rings 62, 64 is a fabric strap 66 which is under and over the opposite ends of the rings 62, 64, and threaded over the top of the ski boot toe portion 68, terminating in a closed loop configuration attachment 70 to the strap loop 52, wherein any excess or looseness in the length of the strap 66 over the boot toe portion 68 is removed by pulling up on the strap end 66, and slippage prevented by a binding of the rings 62, 64 in their "under and over" wrap about the rings 62, 64.

Each bracket 28 is attached to an outboard side of a ski boot 14, 16 affording the skier 72 with the option of rail skiing on his/her left or right foot. During skiing, the skier 72 assumes an operative leaning position, as noted by the arrow 74, over and shifted sidewise of the rail 32 to provide balance while skiing in descending movement 76 down along the rail 32, during which the ski on the rail is out-of-contact with the ski slope 10, as well as the ski on the other leg, but both of which skis are in the ready position to continue skiing upon a dismount from the end of the rail 32, at the unimpeded increased speed of descent afforded by the rail skiing style.

It is to be noted that the physical presence of the supported rail 32 effectively clears the path of movement 76 for the skier 72 of other skiers that otherwise might be in harm's way, and is a noteworthy safety aspect of the rail skiing style that has been described, particularly because the linear descent is, by its nature, at an increased rate of speed over a traditional alternating curvilinear path of descent.

While the apparatus for practicing the within inventive method, as well as said method herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. A skiing style-modification improvement for ski boot having attached thereto a ski with opposite side edges therealong in the skiing use of which said edges have a steering function providing a curvilinear path at a diminished speed of descent, said skiing style modification comprising, in combination:

A. a rail of metal construction material of a rectangular shape in cross section disposed on a ski slope sized to have sides of approximately not less than three inches in height and a flat top subtending angles with said sides of ninety degrees forming operative tracking edges lengthwise of said rail and for a length thereof of approximately not less than fifteen feet;

B. a skiing component in attached relation to an outboard side of said ski boot with attached ski having an operative position in sliding contact with a rail tracking edge, said skiing component consisting of:

(1) a bracket with an angularly oriented plate and a laterally extending plate subtending an angle slightly greater than ninety degrees therebetween;

(2) said angular and lateral plates bounding a positioning compartment into which said tracking edge is projected incident to establishing said sliding contact therewith; and wherein in use over said rail, said skiing style-modification providing balance while skiing and holding said ski opposite edges in a clearance position out-of-contact with said ski slope;

whereby a skier's path of descent is linear as dictated by said tracking edge and at an increased rate of speed.

* * * * *